US011164714B2

(12) United States Patent
Behling et al.

(10) Patent No.: US 11,164,714 B2
(45) Date of Patent: Nov. 2, 2021

(54) X-RAY TUBE INSULATOR

(71) Applicant: KONINKLIJKE PHILIPS N.V., Eindhoven (NL)

(72) Inventors: Rolf Karl Otto Behling, Norderstedt (NL); Tobias Schlenk, Hamburg (DE); Thorben Repenning, Moorrege (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 23 days.

(21) Appl. No.: 16/623,433

(22) PCT Filed: Jun. 15, 2018

(86) PCT No.: PCT/EP2018/065925
§ 371 (c)(1),
(2) Date: Dec. 17, 2019

(87) PCT Pub. No.: WO2018/234172
PCT Pub. Date: Dec. 27, 2018

(65) Prior Publication Data

US 2021/0151275 A1 May 20, 2021

(30) Foreign Application Priority Data

Jun. 23, 2017 (EP) ..... 17177556

(51) Int. Cl.
*H01J 35/16* (2006.01)
*H05G 1/54* (2006.01)

(52) U.S. Cl.
CPC ..... *H01J 35/165* (2013.01); *H01J 2235/0233* (2013.01); *H05G 1/54* (2013.01)

(58) Field of Classification Search
CPC ..... H01J 2235/023; H01J 2235/168; H01J 2235/165; H01J 35/16; H01J 35/165
See application file for complete search history.

(56) References Cited

U.S. PATENT DOCUMENTS 4,811,375 A 3/1989 Klostermann
4,964,148 A * 10/1990 Klostermann ..... H01J 35/107 378/127

(Continued)

FOREIGN PATENT DOCUMENTS

JP 2001124899 A 5/2011

OTHER PUBLICATIONS

PCT International Search Report, International application No. PCT/EP2018/065925, dated Sep. 26, 2018.

*Primary Examiner* — Chih-Cheng Kao
(74) *Attorney, Agent, or Firm* — Larry Liberchuk

(57) ABSTRACT

The invention proposes an insulator within an X-ray tube having a vacuum side and an ambient side and a feedthrough substantially coinciding with an axis of symmetry at the vacuum side and an axis of symmetry at the ambient side. The axis of symmetry at the vacuum side and the axis of symmetry at the ambient side have an angle of at least 5°, preferably 90°, with respect to each other. An X-ray source comprising such an insulator is presented as well and the present invention also extends to a medical imaging apparatus for generating X-ray images of a patient thereby using an X-ray source with such an insulator. In an embodiment, an X-ray source is provided wherein the insulator is plugged to an electrical connector at the ambient surface.

12 Claims, 3 Drawing Sheets

(56) References Cited

U.S. PATENT DOCUMENTS

| | | | | |
|---|---|---|---|---|
| 5,316,492 | A | 5/1994 | Schaareman | |
| 6,556,654 | B1 | 4/2003 | Hansen | |
| 2004/0028184 | A1* | 2/2004 | Hansen | H01R 33/7678 378/123 |
| 2008/0293298 | A1 | 11/2008 | Burris | |
| 2009/0285360 | A1 | 11/2009 | Cao | |
| 2015/0124936 | A1 | 5/2015 | Anno | |
| 2016/0209288 | A1* | 7/2016 | Kelly | G01L 21/30 |

* cited by examiner

X-RAY TUBE INSULATOR

FIELD OF THE INVENTION

Generally, the invention relates to the field of X-ray sources and/or X-ray generators for generating X-ray radiation. In particular, the present invention relates to an asymmetric X-ray tube insulator, an X-ray source for generating X-rays and a medical imaging apparatus for generating images of a patient.

BACKGROUND OF THE INVENTION

High voltage ceramics insulators for X-ray tubes isolate high from ground potential and enable electrical supply with feedthroughs for e.g. control voltages, currents, sensor signals, heat.

Axisymmetric designs are preferred to simplify manufacturing and minimizing thermal or electrical distortions. These insulators may be cylindrical, conic or substantially flat, also referred by the skilled person as "pancake" insulator. They are typically structured, e.g. to shield triple points and function even under adverse conditions at the vacuum side like influence of ionizing agents like charge carriers, UV or X-rays as well as at the ambient side under oil or flexible bulk insulators (rubber, silicone sheets, plastics etc.)

High voltage ceramics insulators are usually the interface between vacuum and ambient oil, rubber, silicon or plastic insulation.

U.S. Pat. No. 4,811,375A describes an X-ray tube that comprises a generally cylindrical evacuated metal tube envelope having an anode rotatably mounted therein. The interior of the tube envelope adjacent the anode is provided with ceramic insulation to prevent flashover. The anode is rotated by an external variable speed DC drive motor magnetically coupled through the tube envelope wall to the rotating anode assembly. The tube envelope wall includes ferrous segments which minimize the gap in the magnetic coupling while permitting a thick and strong tube envelope wall. A variable speed DC motor or a variable speed air motor may be employed to drive the anode. In preferred embodiments, the anode drive means is electromechanically clutched to the anode, whereby the drive means can be brought up to the desired anode speed and thereafter clutched to the anode, the drive means acting as a flywheel to bring the anode quickly up to speed. Electromagnets operating as clutches are also employed. Additionally, the anode drive means may be operated at high speeds suitable for radiography, and the electromagnetic clutch means may be intermittently operated to maintain the anode rotating during fluoroscopy. When a radiograph is required in the midst of fluoroscopy, the electromagnetic clutch is actuated to bring the anode up to its full speed. Alternate drive means include a DC stator external of the tube envelope acting on an internal rotor mounted to rotate with the anode. The X-ray tube further comprises a cathode rotatably mounted in the tube envelope and incorporating plurality of cathode filaments. Cathode rotation drive means are provided for rotating the cathode to select the desired filament. The cathode drive means is preferably magnetically coupled through the tube wall in order to rotate the cathode. The DC drive motor includes a DC stator external of the tube envelope operating on a rotor having encapsulated rare earth magnets and an AC stator operating on a squirrel cage rotor through a laminated segmented tube wall. A fan is provided for air cooling of the tube envelope.

SUMMARY OF THE INVENTION

The inventors of the present invention have found that as the vacuum interface is usually the weakest in terms of permitted maximal electric field strength, a mismatch of required size may exist between both interfaces. Coaxial designs, as used in the prior art so far, may then become bulky.

There may therefore be a need for an improved manner of isolating electrical ground potentials from the electric potential of a feedthrough of an insulator, which is used in an X-ray tube.

This is achieved by the subject-matter of the independent claims, wherein further embodiments are incorporated in the dependent claims and the following description.

According to a first aspect of the invention, an asymmetric X-ray tube insulator for providing an isolation between an electrical ground potential and an electric potential of a feedthrough is presented. The asymmetric X-ray tube insulator comprises a vacuum interface for being contacted with the vacuum zone of the X-ray tube, and an ambient interface for being contacted with the ambience of the X-ray tube. Moreover, the insulator comprises a feedthrough channel inside the insulator for receiving the feedthrough for guiding the electric potential of the feedthrough from the ambient interface to the vacuum interface. Moreover, the feedthrough channel extends inside the insulator from the vacuum interface to the ambient interface. The vacuum interface and the ambient interface of the insulator are angled with respect to each other.

In other words, the asymmetric X-ray tube insulator, hereinafter referred to as the "insulator", has a vacuum interface and an ambient interface, which are generally not parallel to each other. Instead, said interfaces extend perpendicular to a respective axis of symmetry, but both symmetry axes are not identical, but angled with respect to each other. This will become apparent from and elucidated hereinafter with several different embodiments. This is in contrast to the axisymmetric prior art insulators, where both the vacuum interface and the ambient interface extend perpendicular to symmetry axes, respectively, which are parallel or identical. Therefore, the asymmetric insulator of the present invention may be seen as providing for a non-coaxial design of an insulator to be used in the X-ray tube. It is understood by the skilled reader that the angled configuration of the vacuum interface and the ambient interface relates to a main surface of the vacuum interface and the main surface of the ambient interface. For example, the surface part of the vacuum interface which extends perpendicularly to the direction along which the feedthrough extends through the vacuum interface is considered by the skilled person when determining the angled configuration between the vacuum interface and the ambient interface. In the same manner, in this exemplary example, the surface part of the ambient interface which extends perpendicularly to the direction along which the feedthrough extends through the ambient surface or ambient interface is used for the determination of the angled configuration of the asymmetric insulator. This concept of angled interfaces is explained in the context of and elucidated with several different embodiments and can clearly be gathered from for example the embodiment of FIG. 2.

In other words, the asymmetric shape of the insulator allows that the feedthrough channel extends from the ambient interface into the insulator along a first direction and that the feedthrough channel extends from the vacuum interface into the insulator along another direction, wherein the first and second directions are non-parallel to each other. This geometrical aspect of the insulator will be explained in the context of and elucidated with several different embodiments hereinafter.

The inventors of the present invention have found during their research on X-ray tubes that for future applications of X-ray tubes, the horizontal width, i.e. the axial thickness, of the insulator should be reduced. Such horizontal width of the insulator can be seen from for example FIG. 2, wherein the horizontal width is given by the distance between the vacuum interface 201 and the long, electrically conductive outer surface on the right-hand side of FIG. 2 (running along the direction from the top to the bottom of FIG. 2) where both reference signs 208 and 214 end. This horizontal width of the insulator is minimized due to the angled, non-coaxial configuration, i.e. due to the asymmetric shape of the insulator 200. In general, the asymmetric insulator of the present invention, which comprises a vacuum interface and an ambient interface which are angled with respect to each other, provides for such a reduced horizontal width. This asymmetric shape significantly reduces this horizontal width of the insulator thereby allowing the application of the insulator in future X-ray tubes where this space might be limited. At the same time, the asymmetric shape of the insulator allows taking into account the different electrical conditions which the vacuum interface and the ambient interface have to meet. At the vacuum interface, problems may occur due to charge carriers and the issue of discharges needs to be taken into account. The asymmetric geometry of the insulator of the present invention allows to provide for a large vacuum interface while at the same time the diameter of the ambient interface can be significantly reduced. This still matches the electrical needs of both surfaces.

As will become apparent from the following explanation, the insulator of the present invention relates to a solid-state matter insulator, wherein different materials may be used. Different embodiments of material selections will be given hereinafter.

The insulator may comprise one feedthrough channel with a feedthrough extending therein but may of course also comprise two, three, four or more feedthrough channels with corresponding feedthroughs running therein. In preferred embodiments, two, four, or six feedthrough channels with respective feedthroughs may be provided by the insulator.

Further, the insulator of the present invention is configured for isolating the electrical ground potential from the electrical potential of the one or more feedthroughs running through the insulator. For medical imaging applications, for example when the asymmetric X-ray tube insulator is used in an X-ray tube of a medical imaging device, typical voltages may range from 20 kV to 150 kV.

However, the field of application of the insulator of the present invention extends beyond the medical imaging field. For example, in the field of non-destructive materials testing, the insulator of the present invention may be used. In this field, voltages of up to 600 kV may be applied and the insulator of this embodiment is configured to provide a corresponding isolation. A further field of application for the insulator of the present invention is the field of diffractometers and the field of fluorescence analysis where chemical compounds are analyzed. In such technical fields, voltages of only 10 kV may be applied and the insulator of the present invention can of course provide a corresponding isolation also for such an application.

Therefore, according to exemplary embodiments of the present invention, a medical imaging apparatus with an X-ray tube comprising the asymmetric X-ray tube insulator is presented. In an alternative embodiment, a device for non-destructive material testing is presented which comprises an X-ray tube with the asymmetric X-ray tube insulator of the present invention. In a further exemplary embodiment, a device for diffractometry or for fluorescence analysis is presented with an X-ray tube and the asymmetric X-ray tube insulator.

As is clear to the skilled reader, the vacuum interface of the insulator is in contact with the vacuum zone of the X-ray tube when the insulator is applied to or mounted at the X-ray tube itself. Furthermore, in this mounted configuration, the ambient interface of the insulator is in contact with the ambience of the X-ray tube.

The feedthrough may be placed or brought into contact with the feedthrough channel by using different options. According to an exemplary embodiment, the insulator during the production process of the insulator provides the one or more feedthrough channels within the insulator as hollow channels to which the conductive material of the feedthrough is brazed in. Thus, by brazing the electrical feedthrough into the feedthrough channel it can be achieved that no air gaps between the conductive feedthrough and the surrounding solid-state matter of the insulator is enclosed. In an alternative production method, the feedthrough is contacted with the insulator along the feedthrough channel by using a powder sinter method. Typically, in this sintering procedure, temperatures of above 1900° C. are used. After sintering, the ceramics body is typically metallized in the area of the mechanical interfaces and brazed with metal shields and supporting structures.

According to another exemplary embodiment, the insulator comprises an electrically conductive outer surface for carrying the ground potential, wherein the electrically conductive outer surface extends from the vacuum interface to the ambient interface.

The electrically conductive outer surface may be embodied for example as a metallic layer on the outside surface of the insulator. However, according to another exemplary embodiment, not the entire outer surface of the insulator is electrically conductive, but only partial sections of the outer surface are electrically conductive. According to another exemplary embodiment, a semiconducting outer surface is used.

According to another exemplary embodiment of the present invention, the vacuum interface and the ambient interface of the insulator are angled with respect to each other in such a way that the feedthrough channel extends from the vacuum interface into the insulator along a first direction and the feedthrough channel extends from the ambient interface into the insulator along a second direction. In this embodiment, the first and second directions have at least an angle of 5°, preferably 90°, with respect to each other.

As can be gathered for example from the exemplary embodiment of FIG. 2, the two directions can be perpendicularly oriented with respect to each other. In the embodiment of FIG. 2, the first and second directions are equal to the two axes of symmetry 205, 206, since the embodiment of FIG. 2 comprises an ambient interface 202 which shows a rotational symmetry with respect to axes 207, whereas vacuum interface 201 shows a rotational symmetry with respect to symmetry axis 205. However, also other angled configurations, apart from a perpendicular configuration, are embodiments falling within the scope of this invention.

According to another exemplary embodiment of the present invention, the diameter of the vacuum interface exceeds the diameter of the ambient interface by a factor of at least 2.

As can be gathered from for example the embodiment shown in FIG. 2, the diameter of the ambient interface 202 is significantly smaller as compared to the diameter of the vacuum interface 201. The diameters of both interfaces are compared in the cross-sectional view shown by FIG. 2.

According to another exemplary embodiment of the present invention, the insulator is formed of a homogeneous body of isotropic material. In a preferred embodiment, alumina is used.

Due to the use of an isotropic material it is ensured that no electrical effects between different materials within the insulator can occur, since boundary layers are avoided by this embodiment.

According to a further preferred embodiment, the insulator is embodied as a single piece component.

In this embodiment, it is also ensured, that no air gaps between different components of the insulator are comprised which would cause negative electrical effects within the insulator. In particular, such an insulator avoids any disadvantages of unwanted discharge processes. It is of course clear to the skilled person that the isotropic feature mentioned hereinabove, only relates to the insulator itself, whereas the feedthrough material will be different since it is supposed to be non-isolating but carrying the feedthrough voltage.

According to another exemplary embodiment of the present invention, the asymmetric insulator comprises a vacuum interface with a circular symmetry axis and the vacuum interface is embodied as a pancake type of insulator interface which is substantially flat and has a structured surface. Moreover, in this embodiment, the ambient interface has a virtual circular symmetry axis or has a virtual discrete rotational symmetry axis, and both symmetry axes are angulated with respect to each other.

Such a structured surface might be gathered from for example FIG. 2 where two recessions above and below the feedthrough 207 are comprised in the surface of the vacuum interface 201. Nevertheless, such an interface is understood by the skilled person as a pancake type of insulator interface due to its ratio of the diameter and thickness.

It must be noted that the term "pancake type of insulator interface" is commonly used and clearly understood by the skilled person. In particular, the skilled person understands the pancake type of insulator interface as an interface which has a high ratio between the diameter of the interface divided by the depth of the interface. Such a pancake type of insulator interface is shown in FIG. 2 by the vacuum interface 201.

As is commonly used by the person skilled in the art and other than for conic insulators, the axial thickness of a pancake insulator/of a pancake insulator interface is typically shorter than its diameter. The pancake insulator appears basically as a flat disc, at least at the ambient side. The downside of such a short design is a reduction of creeping distances understood as the length of a pathway across the insulator from the high-voltage terminal to ground. A proper structuring of the surface and the bulk material is essential to achieve the necessary high voltage stability even under adverse conditions like free charge carriers in vacuum, high residual gas pressure, vacuum UV illumination, impact of loose particles and so forth.

According to another exemplary embodiment of the present invention, the asymmetric X-ray tube insulator has a vacuum interface with a virtual circular symmetry axis and the vacuum interface is embodied as a pancake type of insulator interface being substantially flat and with a structured surface.

In contrast to the previous embodiment, the insulator has a conical shape at the ambient interface, which typically simplifies achieving a large enough creeping distance. According to another exemplary embodiment of the present invention, the insulator has a conical shape at the vacuum interface and the ambient interface has a virtual circular symmetry axis and is embodied as a pancake type of insulator being substantially flat and with a structured surface.

According to another exemplary embodiment of the present invention, the symmetry axis of the vacuum interface extends parallel to a direction along which the feedthrough channel extends from the vacuum interface into the insulator. Furthermore, the symmetry axis of the ambient interface extends parallel to a direction along which the feedthrough channel extends from the ambient interface into the insulator. Such an embodiment in which both virtual symmetry axes of both interfaces are parallel to the direction exits the two interfaces is shown in the non-limiting example of FIG. 2. According to another exemplary embodiment of the present invention, the feedthrough channel inside the insulator is curved and/or angled within the insulator.

This curved and/or angled path feature of the feedthrough channel may of course apply to several channels, which are comprised by the insulator in embodiments containing several feedthroughs.

According to another exemplary embodiment of the present invention, the electrically conductive outer surface extends from the vacuum interface perpendicularly towards an angled section of the insulator. Moreover, the electrically conductive outer surface of the insulator extends from the ambient interface perpendicularly towards said angled section of the insulator.

As can be gathered from FIG. 2 for example, the ground potential which is guided along the circumference of the insulator, both ends of the insulator 200 extend perpendicularly away from the respective interface and then meet at a section where the outer surface of the insulator is angled. For example, in the non-limiting embodiment of FIG. 2, a perpendicular section is comprised on the inner, short mechanical connection between the two interfaces. This inner, short mechanical connection, is shown in FIG. 2 on the left-hand side. In contrast thereto, the longer mechanical connection between the two interfaces, shown in FIG. 2 on the right-hand side, comprises two angled sections with a 45° angle each. As is clear to the skilled person from this disclosure, also several different angles may be used based on different geometries provided according to different embodiments of the present invention.

According to another exemplary embodiment of the present invention, the electrically conductive outer surface circumferentially encloses the vacuum interface and the ambient interface.

According to another aspect of the present invention, an X-ray source for generating X-rays is presented. The X-ray source comprises an insulator according to any of the herein mentioned embodiments or aspects. The insulator is in contact with the vacuum zone of the X-ray source via the vacuum interface and the insulator is in contact with the ambience of the X-ray source via the ambient interface.

Such an X-ray source may be applied within several different technical fields. For example, such an X-ray source may be applied within an X-ray imaging device used for medical purposes, or may be used within a non-destructive material testing device or may be used within a diffractometry device or a fluorescence analysis device. In an embodiment, an X-ray source is provided wherein the insulator is plugged to an electrical connector at the ambient surface.

According to another exemplary embodiment of the present invention, a medical imaging apparatus is presented for generating X-ray images of a patient, wherein the apparatus comprises an X-ray source with an insulator according to any of the embodiments and aspects mentioned herein.

These and other aspects of the invention will be apparent from and elucidated with reference to the embodiments described hereinafter.

BRIEF DESCRIPTION OF THE DRAWINGS

The subject-matter of the invention will be explained in more detail in the following with reference to the exemplary embodiments which are illustrated in the attached figs, wherein.

DETAILED DESCRIPTION OF EMBODIMENTS

Figure 1:
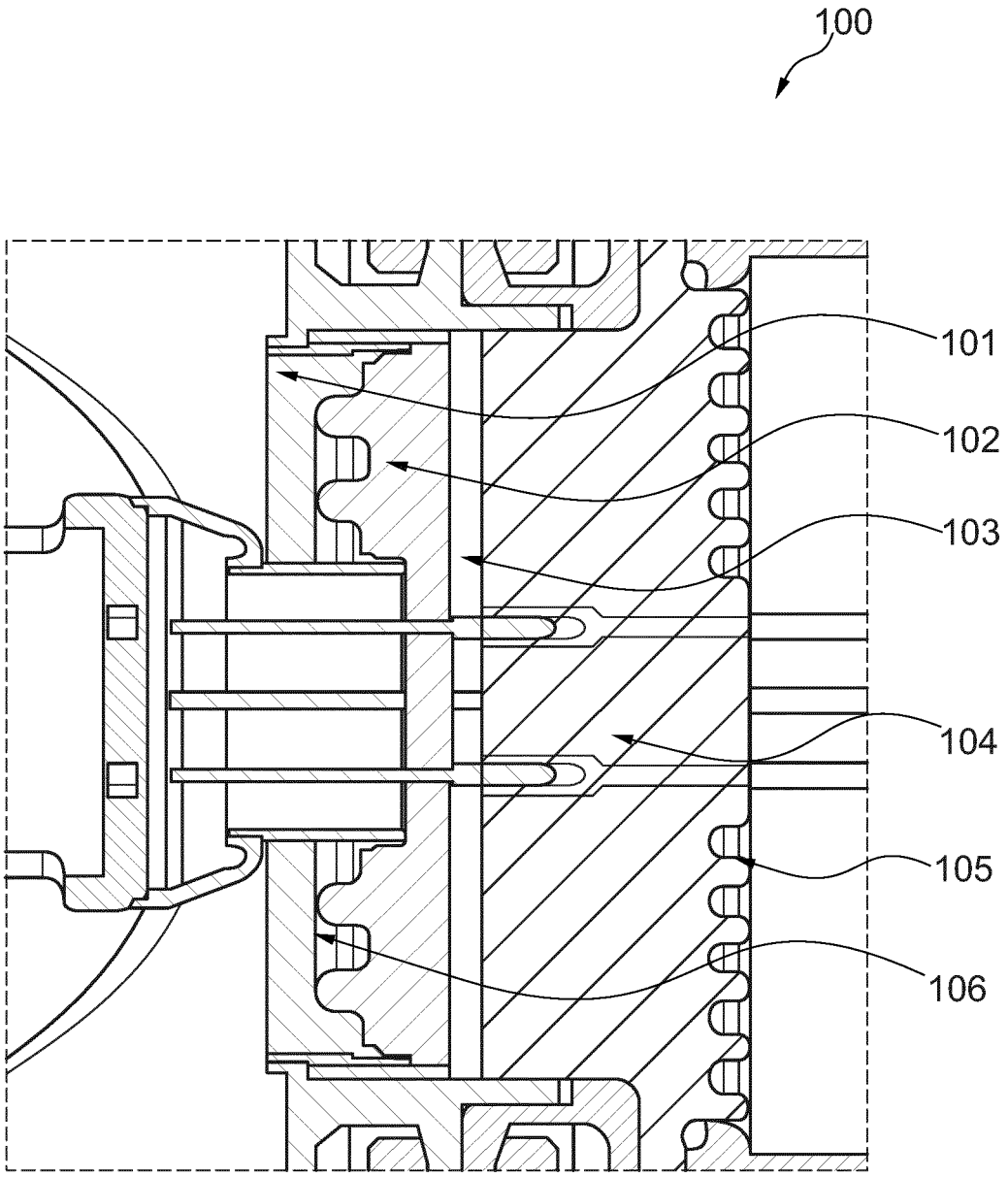
FIG. 1 shows a cross-sectional view through a prior art insulator typically used in X-ray sources.

FIG. 1 schematically shows a cross-section through an X-ray source comprising an X-ray source insulator of the prior art. The X-ray source 100 is shown with the vacuum zone 101 with the alumina part 102. The vacuum interface is depicted in FIG. 1 by reference sign 106. Furthermore, a silicon slab 103 is comprised, which is an electrically stable interface where a small diameter suffices. Moreover, a plastic insulator 104 is comprised in the setup shown in FIG. 1. The X-ray source 100 also comprises the oil or cable interface 105, which is the interface to the ambience. As can be seen from FIG. 1, the prior art makes use of axisymmetric designs since they are simplifying manufacturing and minimizing thermal or electrical distortions. So far, the skilled persons have considered such axisymmetric and/or concentrical X-ray insulators as beneficial and sufficient since they successfully shield even under adverse conditions at the vacuum side like influencing of ionizing agents like charge carriers, UV or X-rays as well as at the ambient side under oil or flexible bulk insulators.

However, the inventors of the present invention have found during their research that a different geometry of the insulator is beneficial for several different applications of X-ray sources in the future. In an embodiment, the inventors of the present invention suggest the use of angulated isotropic insulators, for example angulated alumina ceramics insulators, which represent the interface between the vacuum and the ambience. This may be applied for X-ray tubes and other vacuum electronic devices.

Figure 2:
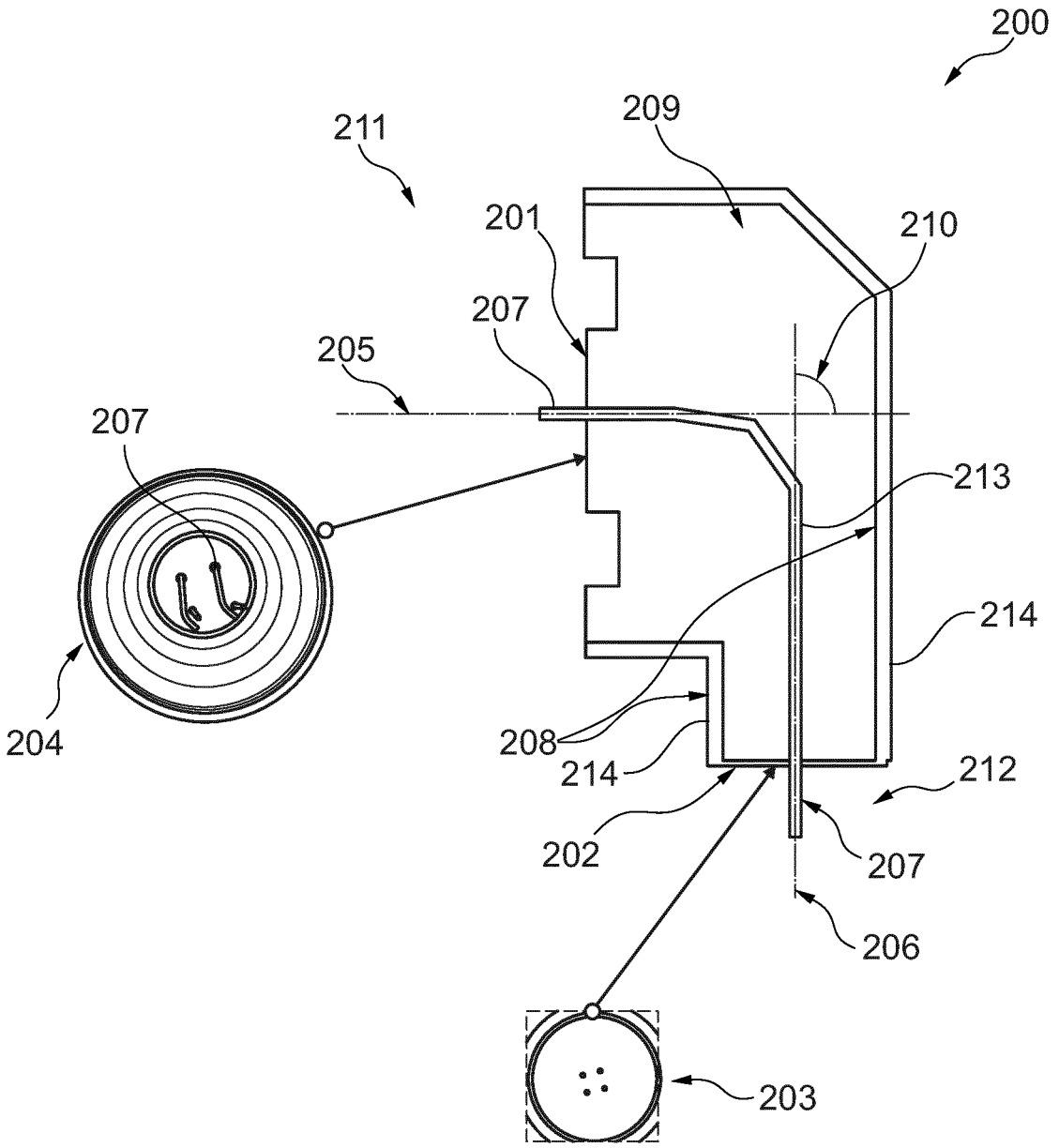
FIG. 2 schematically shows a cross-section through an asymmetric insulator according to an exemplary embodiment of the present invention.

As a non-limiting example, FIG. 2 shows a cross-section of an asymmetric X-ray tube insulator 200 for providing an isolation between an electrical ground potential 208 and an electrical potential of a feedthrough 207. The insulator comprises a vacuum interface 201 for being contacted with the vacuum zone 211 of the X-ray tube. Moreover, the ambient interface 202 is configured for being contacted with the ambience 212 of the X-ray tube. The feedthrough channel 213 extends inside the insulator and is configured for receiving the feedthrough for guiding the electrical potential of the feedthrough from the ambient interface to the vacuum interface. Electrical connectors and cables may then be applied to the feedthrough or the feedthroughs of the insulator at the vacuum side in order to bring electrical power to several different devices, like for example control devices, sensors or heating devices. As can be seen from FIG. 2, the feedthrough channel 213 extends inside the insulator 200 from the vacuum interface 201 to the ambient interface 202. The vacuum interface 201 and the ambient interface 202 are angled with respect to each other. Hence, a non-coaxial and non-axisymmetric design and geometry is provided. While taking into account the mismatch of required size between both interfaces, the insulator 200 of this embodiment is extremely flat along the symmetry axis 205 of the vacuum interface 201. In other words, the horizontal width, i.e. the axial thickness, of the insulator 200 in the shown cross-sectional view is reduced by means of the asymmetric geometry.

The insulator 200 comprises also an electrically conductive outer surface 214 for carrying the ground potential 208. The electrically conductive outer surface 214 extends from the vacuum interface 201 to the ambient interface 202. The angled configuration of both interfaces 201, 202 is characterized in that the feedthrough channel 213 extends from the 201 into the insulator 200 along a first direction which is angled to a second direction along which the feedthrough channel extends from the ambient interface 202 into the isolator 200. The angle of the exemplary embodiment of FIG. 2 is 90°. However, the technical advantage of reducing the thickness of the insulator along the symmetry axis of the vacuum interface can already be achieved with angles that are at least 5°. Hence, according to other exemplary embodiments, an angulation of 10°, 15°, 20°, 30°, 45°, 50°, 60°, 70°, 80° or 85° can be used to realize this technical effect.

It can also be gathered from FIG. 2 that the vacuum interface 201 has a virtual axis of symmetry 205 and the ambient interface 202 has a virtual axis of symmetry 206. In the embodiment of FIG. 2, the angle between the two symmetry axes is 90°. FIG. 2 also shows two top views 203 and 204. Top view 203 shows the top view of the ambient interface 202, whereas top view 204 shows the vacuum interface 201. The electrically conductive feedthrough 207 which runs along the feedthrough channel 213 can be seen within the cross-sectional view on the right-hand side of FIG. 2 and can also be seen in the top view 204. The vacuum zone 211 is thus brought into contact with the vacuum interface 201 whereas the ambient interface 202 is brought into contact with the ambience 212 when the insulator is applied to the X-ray tube. The angle of 90° of the setup of FIG. 2 is depicted in FIG. 2 with reference sign 210. The body 209 of insulator 200 may be out of isotropic material, for example of alumina.

In an embodiment an X-ray source is provided wherein the insulator 200 is plugged to an electrical connector at the ambient surface.

Figure 3:
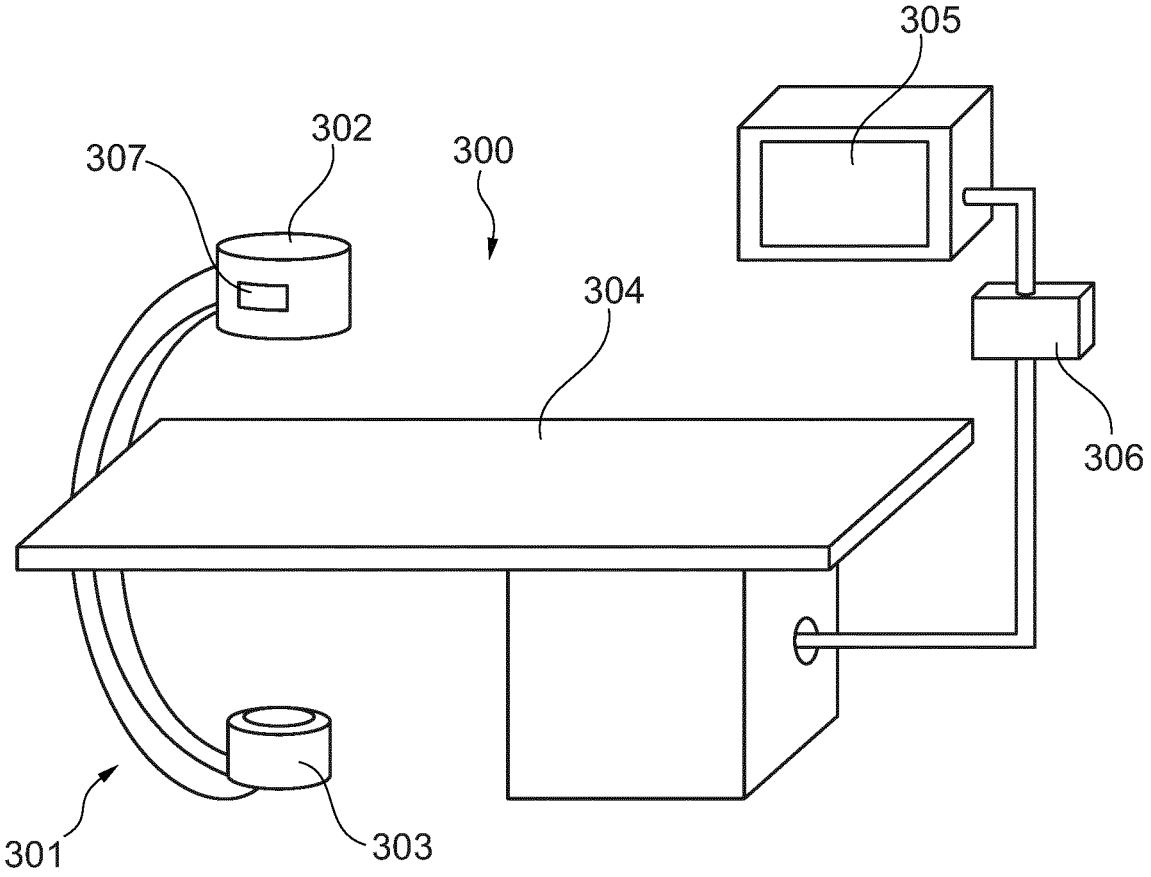
FIG. 3 schematically shows a medical imaging system comprising an X-ray source and an X-ray source insulator according to another exemplary embodiment of the present invention.

According to another exemplary embodiment of the present invention, FIG. 3 shows a medical imaging device 300 for generating X-ray images of a patient. It is clear to the skilled person that this is a schematic, simplified drawing. The medical imaging apparatus 300 comprises an X-ray source 302 with an asymmetric X-ray source/X-ray tube insulator 307, which is only depicted schematically and for illustrative purposes only. This C-arm 301 also comprises the X-ray detector 303 and the patient table 304. The medical imaging system 300 shown in FIG. 3 also comprises a display 305 and a control unit 306 to be used by the medical practitioner. Any of the previously mentioned asymmetric insulators of embodiments of the present invention can be applied and used within the medical imaging system 300 shown in FIG. 3.

In the medical imaging device 300 the following exemplary embodiments of the insulator 307 may be used. For example, the entire insulator 307 (comprising vacuum and ambient insulator interfaces) may consist of a single homogeneous block of isotropic material, e.g. alumina. The block may be manufactured from multiple elements, which are later joined, e.g. by sintering or by gluing or other techniques. The insulator or parts of it may be manufactured by 3D printing. In one embodiment, a pancake type of insulator interface at the vacuum side (substantially flat, structured, circular symmetric) would be accompanied by another insulator interface with ambient which has a different symmetry axis (circular symmetry or discrete rotational symmetry), where both axes are angulated w.r.t. each other.

Alternatively, the medical imaging device 300 comprises a pancake insulator interface at the vacuum side accompanied by an angulated conical insulator structure at the ambient side or vice versa.

In another embodiment of medical imaging device 300 a pancake insulator at the vacuum side is accompanied by a substantially different pancake insulator structure at the ambient side or vice versa.

It may be seen as a gist of the present invention that the insulator has a vacuum side and an ambient side and a feedthrough substantially coinciding with an axis of symmetry at the vacuum side and an axis of symmetry at the ambient side wherein the axis of symmetry at the vacuum side and at the ambient side have an angle of at least 5°, preferably 90° with respect to each other.

The invention claimed is:

1. An asymmetric X-ray tube insulator for providing an isolation between an electrical ground potential and an electrical potential of a feedthrough in an X-ray tube, the insulator comprising:

a vacuum interface configured to be contacted with a vacuum zone of the X-ray tube;

an ambient interface configured to be contacted with an ambience of the X-ray tube;

a feedthrough channel inside the insulator configured to receive the feedthrough for guiding the electrical potential of the feedthrough from the ambient interface to the vacuum interface, wherein the feedthrough channel extends inside the insulator from the vacuum interface to the ambient interface, wherein the vacuum interface and the ambient interface are angled with respect to each other, wherein a first axis normal to the vacuum interface is angled to a second axis normal to the ambient interface by an angle of at least 5°, wherein the vacuum interface includes a first circular part that has a diameter as viewed in a first direction, and the ambient interface includes a second circular part that has a diameter as viewed in a second direction angled to the first direction, wherein the feedthrough channel extends from the first circular part of the vacuum interface into the insulator along the first direction, wherein the feedthrough channel extends from the second circular part of the ambient interface into the insulator along the second direction, wherein the first direction is parallel to the first axis, and wherein the second direction is parallel to the second axis, and wherein the diameter of the first circular part from which the feedthrough channel extends exceeds the diameter of the second circular part from which the feedthrough channel extends by a factor of at least 2.

2. The asymmetric X-ray tube insulator according to claim 1, further comprising an electrically conductive outer surface configured to carry the ground potential, wherein the electrically conductive outer surface extends from the vacuum interface to the ambient interface.

3. The asymmetric X-ray tube insulator according to claim 2, wherein the electrically conductive outer surface extends from the vacuum interface perpendicularly towards an angled section of the insulator, and wherein the electrically conductive outer surface extends from the ambient interface perpendicularly towards the angled section of the insulator.

4. The asymmetric X-ray tube insulator according to claim 2, wherein the electrically conductive outer surface circumferentially encloses the vacuum interface, and wherein the electrically conductive outer surface circumferentially encloses the ambient interface.

5. The asymmetric X-ray tube insulator according to claim 1, wherein the first axis normal to the vacuum interface is a virtual axis of symmetry, and the second axis normal to the ambient interface is a virtual axis of symmetry.

6. The asymmetric X-ray tube insulator according to claim 1, wherein the insulator is formed of a homogeneous body of isotropic material.

7. The asymmetric X-ray tube insulator according to claim 1, wherein the vacuum interface has a virtual circular symmetry axis, wherein the vacuum interface is embodied as a pancake type of insulator interface being substantially flat and with a structured surface, wherein the ambient interface has a virtual circular symmetry axis or has virtual discrete rotational symmetry axis, and wherein the symmetry axes are angulated with respect to each other.

8. The asymmetric X-ray tube insulator according to claim 7, wherein the symmetry axis of the vacuum interface extends parallel to a direction along which the feedthrough channel extends from the vacuum interface into the insulator, and wherein the symmetry axis of the ambient interface extends parallel to a direction along which the feedthrough channel extends from the ambient interface into the insulator.

9. The asymmetric X-ray tube insulator according to claim 1, wherein the vacuum interface has a virtual circular symmetry axis, wherein the vacuum interface is embodied as a pancake type of insulator interface being substantially flat and with a structured surface, wherein a thickness of the virtual circular symmetry axis is shorter than the diameter of the vacuum interface, and wherein the insulator has a conical shape at the ambient interface.

10. The asymmetric X-ray tube insulator according to claim 1, wherein the insulator has a conical shape at the vacuum interface, wherein the ambient interface has a virtual circular symmetry axis, and wherein the ambient interface is embodied as a pancake type of insulator interface being substantially flat and with a structured surface.

11. The asymmetric X-ray tube insulator according to claim 1, wherein the feedthrough channel inside the insulator is curved and/or angled within the insulator.

12. A medical imaging apparatus for generating X-ray images of a patient, the medical imaging apparatus comprising:

an X-ray source, the X-ray source including a vacuum zone and an ambience; and an asymmetric X-ray tube insulator configured to provide an isolation between an electrical ground potential and an electrical potential of a feedthrough in an X-ray tube, the insulator comprising:

a vacuum interface contacted with a vacuum zone of the X-ray tube;

an ambient interface contacted with an ambience of the X-ray tube;

a feedthrough channel inside the insulator receiving the feedthrough for guiding the electrical potential of the feedthrough from the ambient interface to the vacuum interface, wherein the feedthrough channel extends inside the insulator from the vacuum interface to the ambient interface, wherein the vacuum interface and the ambient interface are angled with respect to each other, wherein a first axis normal to the vacuum interface is angled to a second axis normal to the ambient interface by an angle of at least 5°, wherein the vacuum interface includes a first circular part that has a diameter as viewed in a first direction, and the ambient interface includes a second circular part that has a diameter as viewed in a second direction angled to the first direction, wherein the feedthrough channel extends from the first circular part of the vacuum interface into the insulator along the first direction, wherein the feedthrough channel extends from the second circular part of the ambient interface into the insulator along the second direction, wherein the first direction is parallel to the first axis, and wherein the second direction is parallel to the second axis, and wherein the diameter of the first circular part from which the feedthrough channel extends exceeds the diameter of the second circular part from which the feedthrough channel extends by a factor of at least 2.

* * * * *